US006386689B1

(12) United States Patent
Sasada

(10) Patent No.: US 6,386,689 B1
(45) **Date of Patent: *May 14, 2002**

(54) INK JET PRINTERS

(75) Inventor: Hiroyasu Sasada, Tokyo (JP)

(73) Assignee: Mutoh Industries Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,159

(22) Filed: Oct. 27, 2000

Related U.S. Application Data

(62) Division of application No. 09/505,667, filed on Feb. 17, 2000, now Pat. No. 6,199,976.

(30) Foreign Application Priority Data

Mar. 1, 1999 (JP) ..... 11-52226

(51) Int. Cl.[7] ..... B41J 2/175
(52) U.S. Cl. ..... 347/85
(58) Field of Search ..... 347/85, 86, 87, 347/89, 29, 30, 35, 22, 36

(56) References Cited

U.S. PATENT DOCUMENTS 4,987,429 A 1/1991 Finley et al. ..... 347/85
5,446,486 A * 8/1995 Reis ..... 347/85
5,543,827 A * 8/1996 VanSteenkiste et al. ..... 347/85
5,936,650 A 8/1999 Ouchida et al. ..... 347/89
5,963,236 A * 10/1999 Miyashita et al. ..... 347/85
6,050,680 A * 4/2000 Moriyama et al. ..... 347/85
6,062,671 A 5/2000 Kanda et al. ..... 347/30

* cited by examiner

*Primary Examiner*—Judy Nguyen
(74) *Attorney, Agent, or Firm*—Sughrue Mion, PLLC

(57) ABSTRACT

An ink jet printer that prints high quality wherein ink has minimum contact with the atmosphere, high volatility and is easy to separate. The ink jet recording heads and the sub tanks are mounted at the side of the Y cursor, and the main tanks are disposed at the side of the printer body. Upon completion of printing or standby for printing, the ink in the sub tanks is recovered to the side of the main tanks, and the ink in the recording heads is recovered to the side of the waste solution tank. After the ink in the sub tanks is recovered to the side of the main tanks, and before the ink in the main tanks is supplied into the sub tanks, the ink in the main tanks is stirred. After the ink in the recording heads is recovered to the waste solution tank, the inside of the recording heads is cleaned with the cleaning solution, and after the cleaning, the air is supplied into the recording heads, and the inside of the recording heads is dried. The atmosphere release valve is provided on the sub tanks, and after filling the ink in the recording heads, the atmosphere release valve is closed, except during printing and the supply and discharge of the ink to the sub tanks so that the ink in the sub tanks is not evaporated.

10 Claims, 12 Drawing Sheets

INK JET PRINTERS

This is a Divisional Application of application Ser. No. 09/505,667 filed Feb. 17, 2000, U.S. Pat. No. 6,199,976, the disclosure of which is incorporated herein by reference.

BACKGROUND OF THE INVENTION

The present invention relates to ink jet printers, and more particularly, it relates to ink jet printers in which sub tanks are mounted at the side of recording heads, and main tanks are provided at the side of the printer body, and ink filled in the main tanks are supplied to the sub tanks and recording is carried out by the recording heads of ink jet type.

The ink jet printers are disclosed in Japanese Patent Laid-open Publication No. H 10-86395 and other publications in which sub tanks for ink are mounted at the side of recording heads, and main tanks for ink are mounted at the printer body side, and the ink is supplied from the main tanks to the sub tanks, and the ink is supplied from the sub tanks to the recording heads, and the ink is discharged from the recording heads to the paper to carry out a drafting. Also, in Japanese Patent Laid-open Publication No. H 05-294528, the ink jet printer is disclosed in which the paper is guided onto a large diameter platen roller, and a drafting is carried out by the ink jet head on this platen roller.

As the ink for recording on the paper, the solvent ink has heretofore been known. This solvent ink has an advantageous point that the recorded surface keeps its ink stuck to the surface since the ink is fully dissolved therein. For this reason, there is no necessity of coating a protective film such as a lamination on the recording surface on which the recording is applied with the solvent ink.

However, the solvent ink has an alcoholic ingredient that has high volatility which is easily dried up as compared with aqueous ink, but on the other hand, it instantly becomes solid. Also, there is a quality that if it remains as it is, the pigment ingredient separates. Accordingly, in order to use such solvent ink and other easily volatile inks for use in the ink jet printers, a sealing quality is required in whole of ink supply paths, and basically, contact of the ink with atmosphere should be prevented as much as possible, and evaporation of the ink must be prevented. For this purpose, there is a need for keeping the ink in the recording heads, tubes, sub tanks for a long period of time. Furthermore, unless the ink is periodically stirred and mixed, there is an apprehension that the ink ingredient tends to separate.

An object of the present invention is to solve the foregoing points.

SUMMARY OF THE INVENTION

The present invention is to provide a high quality drafting with an ink that has a minimum contact with atmosphere and has high volatility and its ink ingredient tends to separate.

Ink jet type recording heads and sub tanks are mounted at the side of a Y cursor, and main tanks are disposed at the side of the printer body. When the drafting is completed or is in standby for drafting, the ink in the sub tanks are recovered to the side of the main tanks, and the ink in the recording heads are recovered at the side of a waste solution tank. After the ink in the sub tanks is recovered to the side of the main tanks, and before the ink in the main tanks is supplied into the sub tanks, the ink in the main tanks is stirred. After the ink in the recording heads is recovered to the side of the waste solution tank, the insides of the recording heads are cleaned with the cleaning solution, and after the cleaning, the air is supplied into the recording heads, and the inside of the recording heads is dried up. An atmosphere release valve is provided for the sub tank, and after filling the ink in the recording head, the atmospheric release valve is closed except for the drafting time and the supply/discharge operation of the ink into the sub tanks, and thus, the ink in the sub tanks is prevented from it being evaporated.

DETAILED DESCRIPTION OF THE INVENTION

The construction of the present invention will be described hereinafter in detail by referring to the attached drawings.

Figure 2:
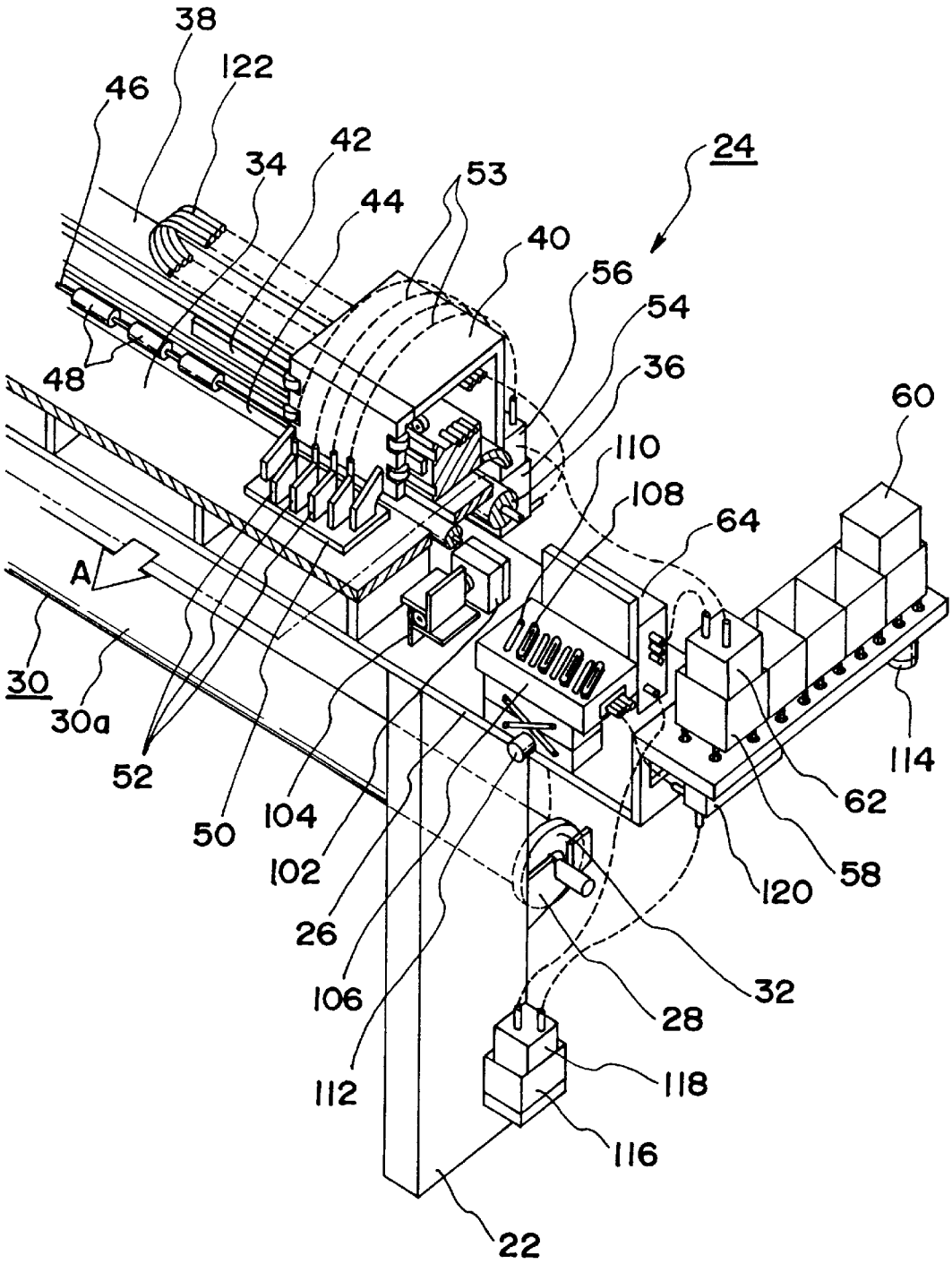
FIG. 2 is an appearance explanatory drawing of an essential part of the plotter.

In FIG. 2, numeral 22 denotes legs (another is omitted) disposed at right and left of a substrate 26 of an ink jet printer 24, and the substrate 26 is fixed to the upper ends thereof. The legs 22 and the substrate 26 constitute the printer body of the ink jet printer 24. At the upper parts of the legs 22, a shaft holder 28 is fixed, and a shaft portion of a roll paper holder 32 to which a roll portion 30*a* of a roll paper 30 is detachably fixed is rotatably and detachably journalled on the shaft holder 28. The substrate 26 is fixed with a platen 34 (paper guide plate), and in the vicinity of an upper flow end of the platen 34, a guide roller 36 is disposed whose length is almost same with a width of the roll paper 30 extending in Y axis direction. The guide roller 36 is disposed in the upper part of the roll portion 39*a* of the roll paper 30, and both ends of the guide roller 36 are rotatably journalled on the substrate 26 through a bracket. Numeral 38 denotes a Y axis rail, and is disposed horizontally in the upper part of the platen 34, and both ends are journalled on the substrate 26 through the bracket. A Y cursor 40 (carriage) is shiftably mounted on the Y axis rail 38, and the Y cursor 40 is interlinked with a Y axis drive device (not shown) disposed on the substrate 26 through a steel belt 42. A slit is formed on the platen 34 along the Y axis direction, and a drive roller 44 is disposed in the slit. Both ends of the drive roller 44 are rotatably journalled on the substrate 26 through the bracket, and the drive roller 44 is interlinked with an X axis drive device (not shown) disposed on the substrate 26.

A pinch roller shaft 46 is mounted on the Y axis rail 38 through a spring mechanism (not shown) liftably, and the pinch roller 48 fixed rotatably to the pinch roller shaft 46 is to be set either in a condition where it separates from the surface of the drive roller 44 and a condition where it is in contact at a level and springy with the surface.

A head base 50 is fixed to one side of the Y cursor 40, and 4 pieces of ink jet recording heads 52 each of which has multiple heads are mounted on the head base 50. On the other side of the Y cursor 40, 4 pieces of sub tanks 54 are mounted for solvent ink of four colors (black K, cyan C, magenta M, yellow Y) whose number being equal to the number of the recording heads 52, and on the upper cover of the sub tank 54, an electromagnetic valve 56 is mounted. A sensor for detecting a level of the ink is mounted on each sub tank 54. In order to keep a negative pressure in the ink supply path, namely, a tube 53 between the recording head 52 and the corresponding sub tank 54, a solution upper surface of the sub tank 54 is disposed to be lower than a discharge vent of the ink of the corresponding recording head 52. Numeral 58 denotes a main tank case disposed on the substrate 26, and 4 pieces of main tanks 60 for 4 color solvent ink whose number is equal to those of the sub tanks 54 and the cleaning solution tanks 62 are detachably housed. Each main tank 60 and each cleaning solution tank 62 is constructed in such a way that an ink remaining quantity is arranged to be detected by sensors 136 and 138 consisting of limit switches disposed beneath each main tank 60 and each cleaning solution tank 62 which are supported by springs. Numeral 64 denotes a supply controller mounted on the substrate 26, and in which pump 66 and electromagnetic valves 68, 70, 72, 74, 76, 78, 80, 82, 84, 86, 88, 90, 92, 94, 96, 98, 100, 101 are built in its inside, and moreover, an electronic control circuit unit is provided which controls those electronic equipment. Also, a controller (not shown) for controlling the XY axis drive device and recording head 52 and the like is mounted on the substrate 26 of the printer 24. Numeral 102 denotes a wiper motor, and 104 denotes a wiper for cleaning the discharge vent of the recording head 52. Numeral 106 denotes a purge box having a rubber cap 108 for closing the discharge vent of the recording head 52 and an ink waste vent 110 alternately, and being disposed at the side portion of the outside of the drafting range of the substrate 26, and being liftable by means of a motor 112.

Each cap 108 of the purge box 106 and waste vent 110 are connected to a manifold 120 fixed to the substrate 26 through the tube and the electromagnetic valves 92, 94, 96, 98, 100. Numeral 114 denotes a motor for stirring the ink in the main tanks 60, and 116 denotes a waste solution tank case mounted on leg body 22, and 118 denotes a waste solution tank. The waste solution tank 118 is supported by springs housed in a case 116, and quantity of the ink is arranged to be detected by sensors 134 consisting of limit switches disposed between the bottom portion of the tank 118 and the upper surface of the case 116.

Figure 3:
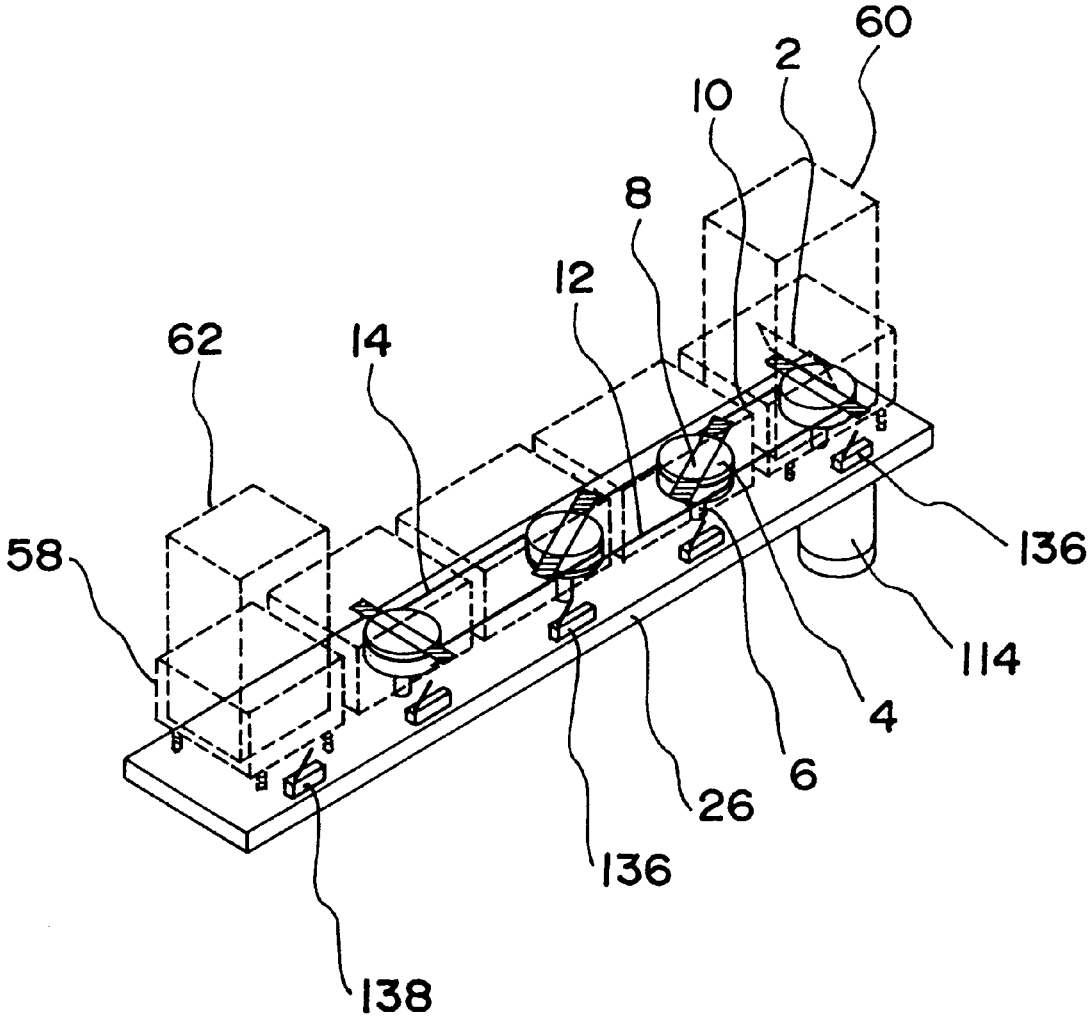
FIG. 3 is an appearance explanatory drawing of an ink stirring mechanism.

On the bottom portion of each main tank 60, as shown in FIG. 3, rotors 2 made from a magnetic material are rotatably journalled. On the substrate 26, pulleys 4 are rotatably journalled for each main tank 60, and a magnet 8 is fixed to each pulley 4. Among 4 pieces of the pulleys 4, a shaft 6 of one pulley 4 is connected to an output of the motor 114. Between each pulley 4, endless wire ropes 10, 12, 14 are spanned, and each pulley 4 is mutually interlocked.

Figure 1:
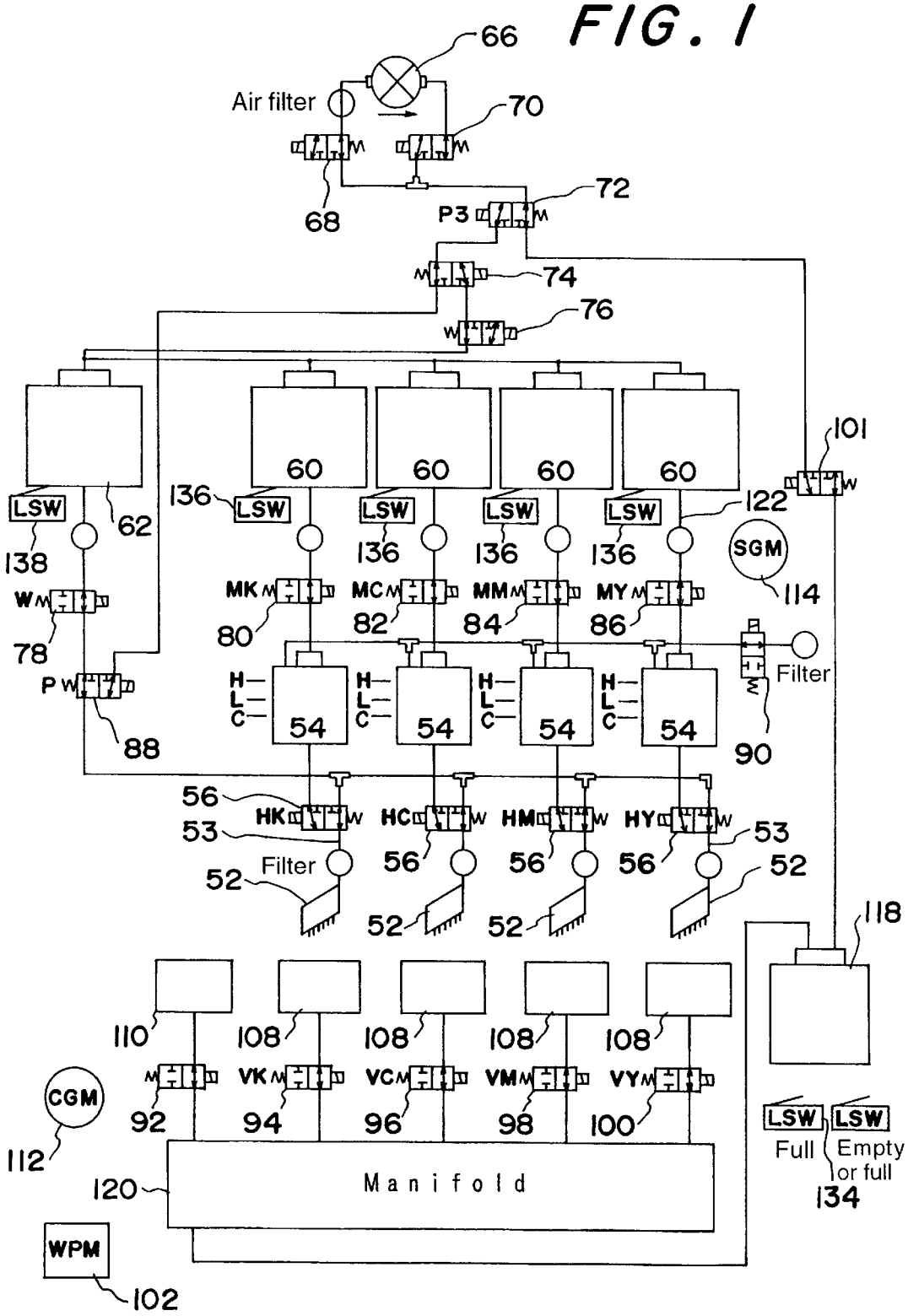
FIG. 1 is a piping explanatory drawing showing an ink supply system of a plotter.

Each of the component parts and the devices are connected by piping made of tubes as shown in FIG. 1. The recording heads 52 can shift immediately above the purge box 106 that is off the drafting range by the shifting of the Y cursor 40 along the Y axis rail 38.

The operation of the embodiment of the present invention will be described in the following.

To set a feed unit of the roll paper 30 on the platen 34, the pinch roller 48 is lifted to feed the roll paper 30 from the roll unit 30*a*, and the roll paper 30 that is fed therefrom is inserted between the drive roller 44 and the pinch roller 48, and thereafter, the pinch roller 48 is descended to arrange the pinch roller 48 to be in resilient contact with the drive roller 44 through the top of the roll paper 30. In this arrangement, the setting of the paper is completed. When the setting of the paper is completed, and the printer enters into a drafting mode, the controller performs an ink filling operation as shown in the flow chart of FIG. 4, and thereafter, shifts to the drafting operation. When the drafting starts, the feed portion of the roll paper 30 is carried in an arrow direction (A) over the platen 34 by the intermittent rotation of one direction of the drive roller 44. Also, the recording heads 52 are driven on the basis of an image information by the control of the controller, and the ink is discharged, and the feed portion of the roll paper 30 is scanned along the Y axis by the reciprocating shift of the Y cursor 40 along the Y axis rail 38, and the image information being spread in the memory of the controller is visible from the surface of the roll paper 30.

When a piezo element of the recording head 52 discharges the ink, the piezo element sucks the ink automatically from the sub tank 54 proportional to the quantity of the suction. In this case, if the sub tank 54 is not set at the negative pressure, the recording head 52 sucks the ink excessively and the ink overflows from the discharge outlet of the nozzle of the recording head 52. To set the sub tank 54 at the negative pressure, the embodiment of this invention sets the position level of the bottom surface of the sub tank 54 downward against the discharge outlet of the recording head 52.

When the drafting operation is completed, judgement of whether or not the sub tank 54 has the ink is made by a signal of the sensor, and no-ink judgement is made, shifts to the ink supply operation. After the ink supply, or if the judgement that the sub tank has the ink is made, judges whether or not a fixed time has passed after the drafting, and if the judgement is affirmative, shifts to the cleaning operation. In case the set time has not passed after the cleaning or the drafting, judges if the set time passed or not from the drafting completion or in the standby condition, and judges negative, returns to the drafting operation. Also, if the judgement is affirmative, shifts sequentially to the ink recovery operation and the head cleaning operation.

Figure 5:
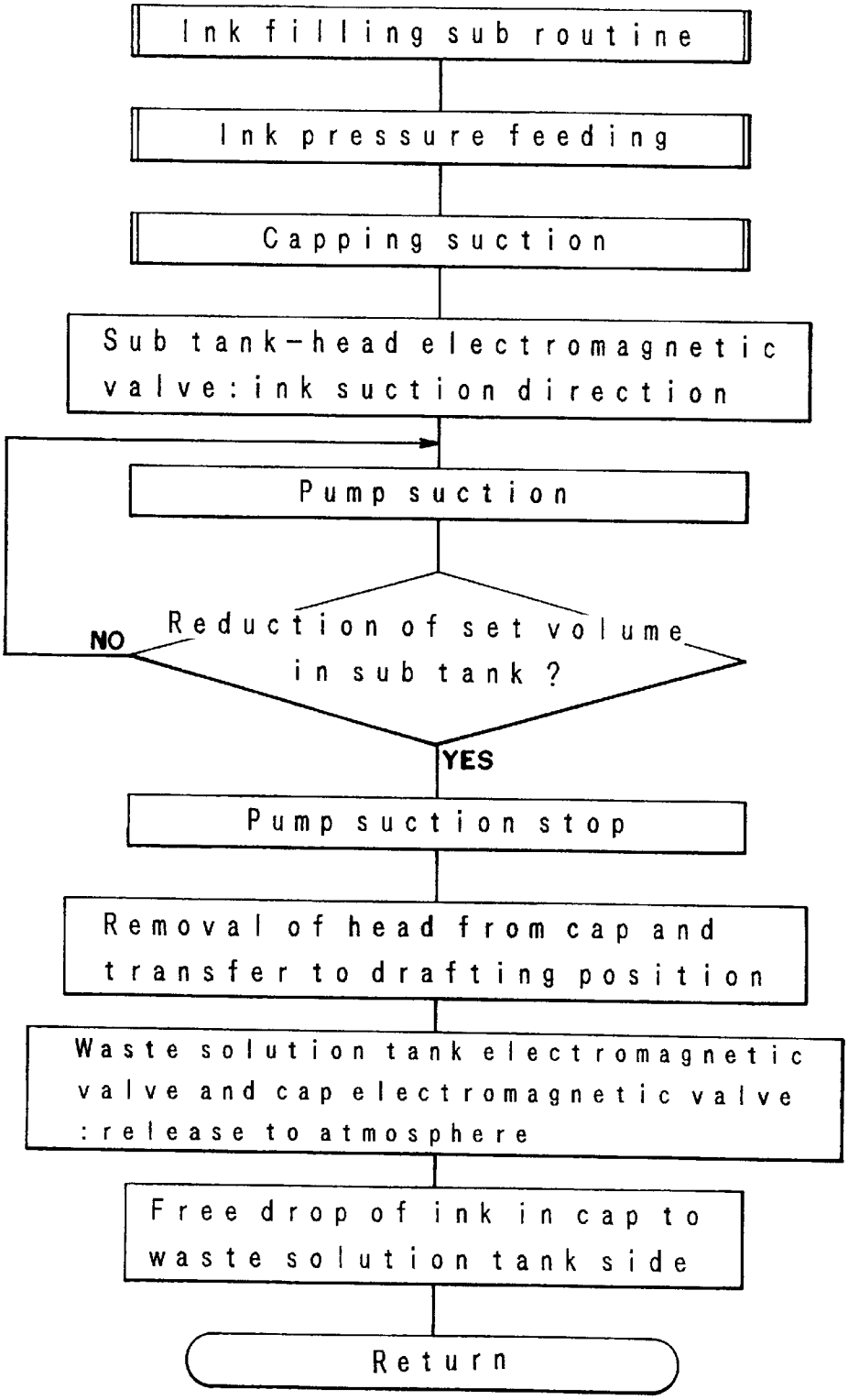
FIG. 5 is a flow chart of an ink filling operation.

Next, the ink filling operation will be described by referring to a flow chart in FIG. 5.

The controller performs the ink pressure feeding and the capping suction sequentially as will be described after shifting to the ink filling operation. By the foregoing operation, the ink is filled in the sub tanks 54, and the inside of the recording heads 52 and the tube 53 connecting the heads and sub tanks become empty. Next, in the condition where the electromagnetic valves 68, 70, 72, 101 are switched to the suction side, the electromagnetic valve 56 is changed over in the ink suction direction to drive the pump 66.

In this manipulation, the inside of the waste solution tank 118 becomes the negative pressure, and the recording heads 52 suck the ink from the sub tanks 54. The controller detects the quantity of the ink in the sub tanks 54, and when a predetermined quantity of the ink is supplied to the recording heads 52 from the sub tanks 54, the suction of the pump 66 stops. In this manipulation, the filling of the ink in the recording heads 52 is completed. At this time, the electromagnetic valve 92 for the waste vent 110 is closed.

After the pump 66 stops the suction, the motor 112 drives to descend the purge box 106, and the cap 108 removes from the recording head 52, and the Y cursor shifts to the drafting position along Y axis rail 38. Next, the waste solution tank electromagnetic valve 101 and the cap electromagnetic valves 92, 94, 96, 98, 100 are released to atmosphere. In this manipulation, the ink in the cap 108 drops freely in the manifold 120.

Figure 4:
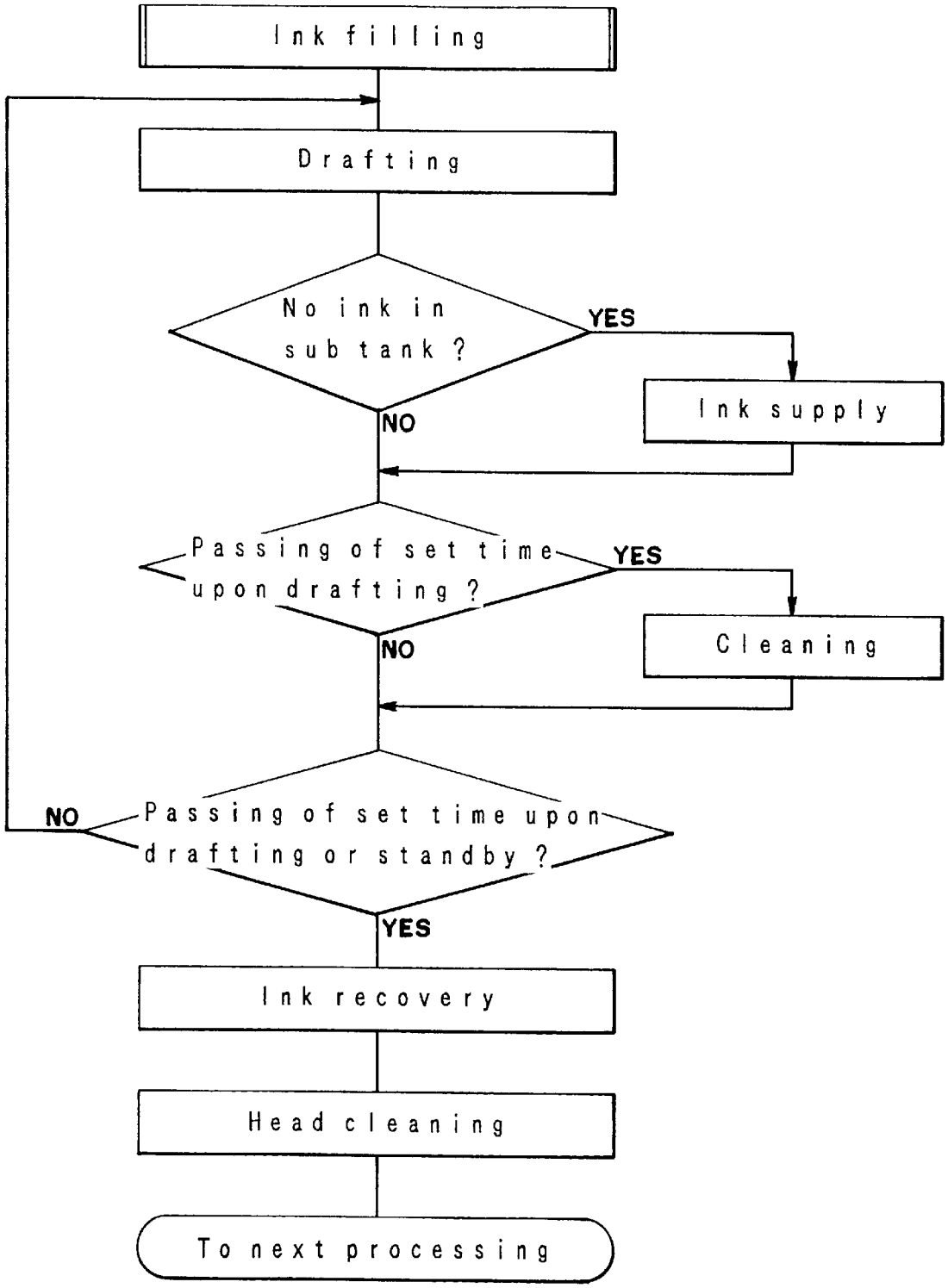
FIG. 4 is a whole flow chart of an ink supply system.
Figure 6:
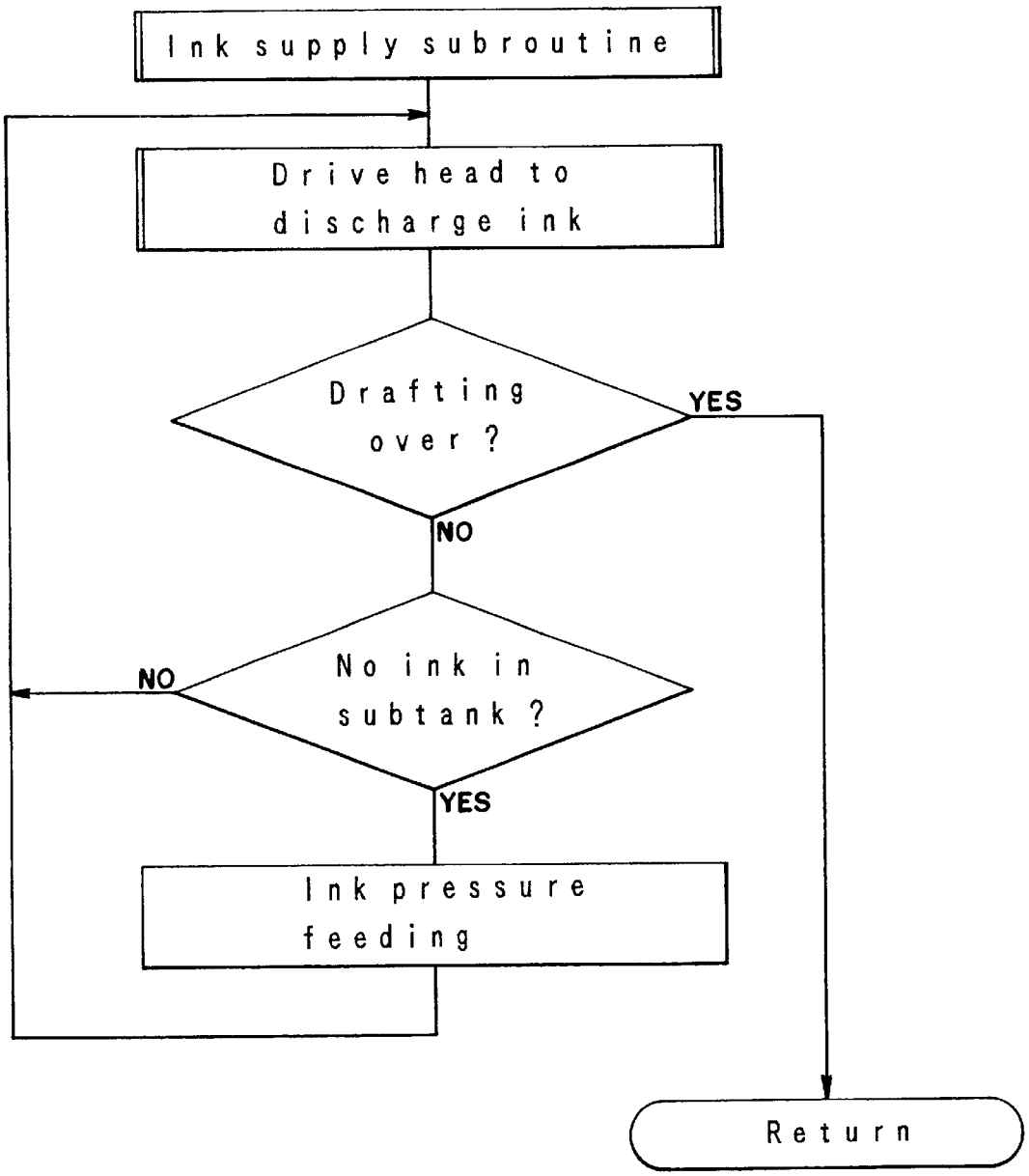
FIG. 6 is a flow chart of an ink supply operation.

Next, the ink supply operation shown in FIG. 4 will be described by referring to a flow chart of FIG. 6.

The recording heads 52 are driven and the ink is discharged from the nozzles and the drafting is carried out. Next, the judgement is made as to if the drafting is completed or not, and in case the judgement is negative, the judgement is made if the sub tanks 54 have no ink. In case the judgement is made that there is no ink in the sub tanks, the operation shifts to the pressure feeding operation as will be described hereinafter, and returns to the drafting operation after supplying the ink to the sub tanks 54.

Figure 7:
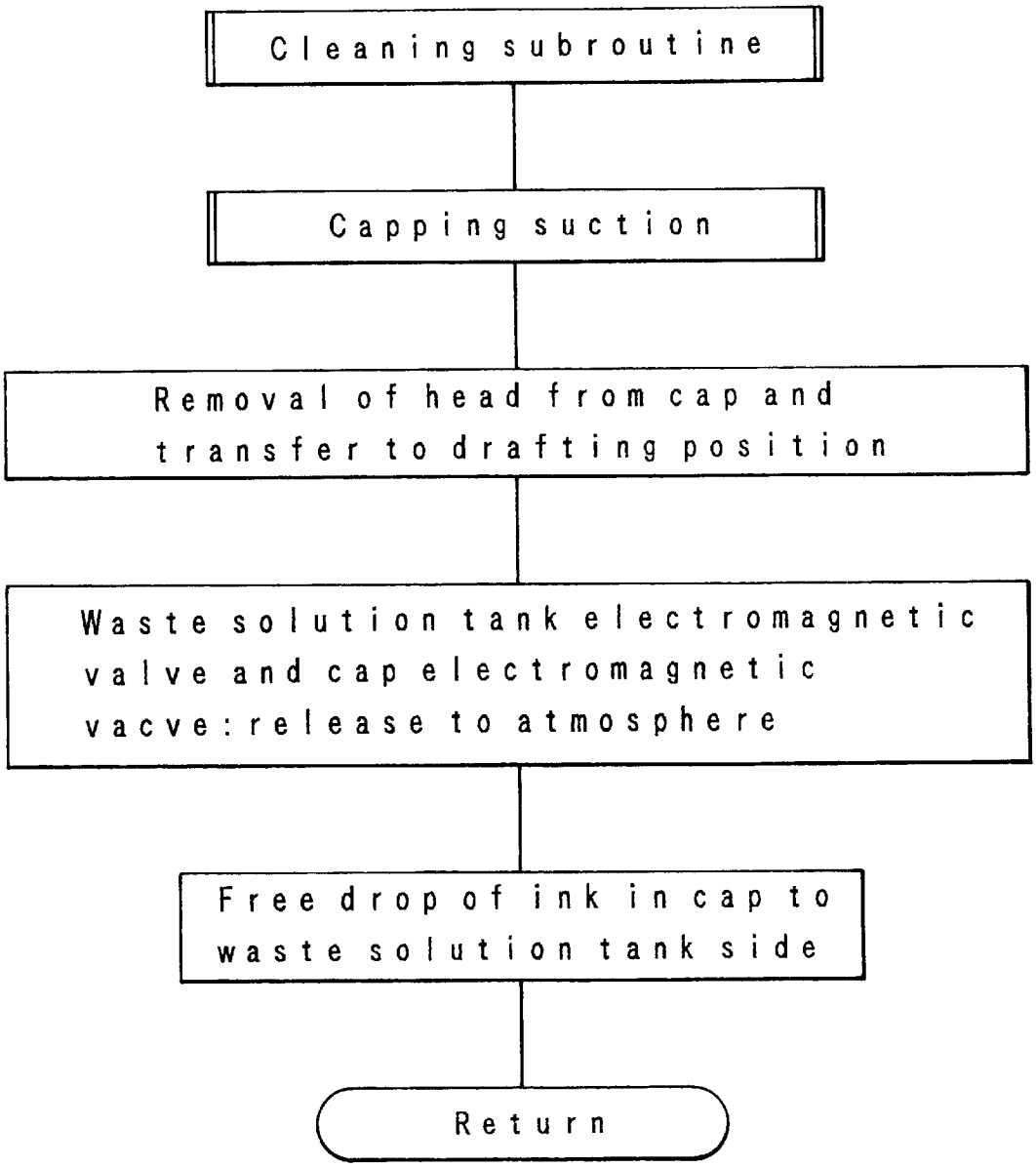
FIG. 7 is a flow chart of a cleaning operation.

Next, the cleaning operation shown in FIG. 4 will be described by referring to a flow chart in FIG. 7.

After the capping suction operation to be described hereinafter, the purge box 106 descends to separate the recording heads 52 from the caps 108, and the recording heads 52 shift to the drafting position. Next, the waste solution tank electromagnetic valve 101 and the electromagnetic valves 92, 94, 96, 98, 100 are released to atmosphere and the ink in the caps 108 is freely dropped in the manifold 120.

Figure 8:
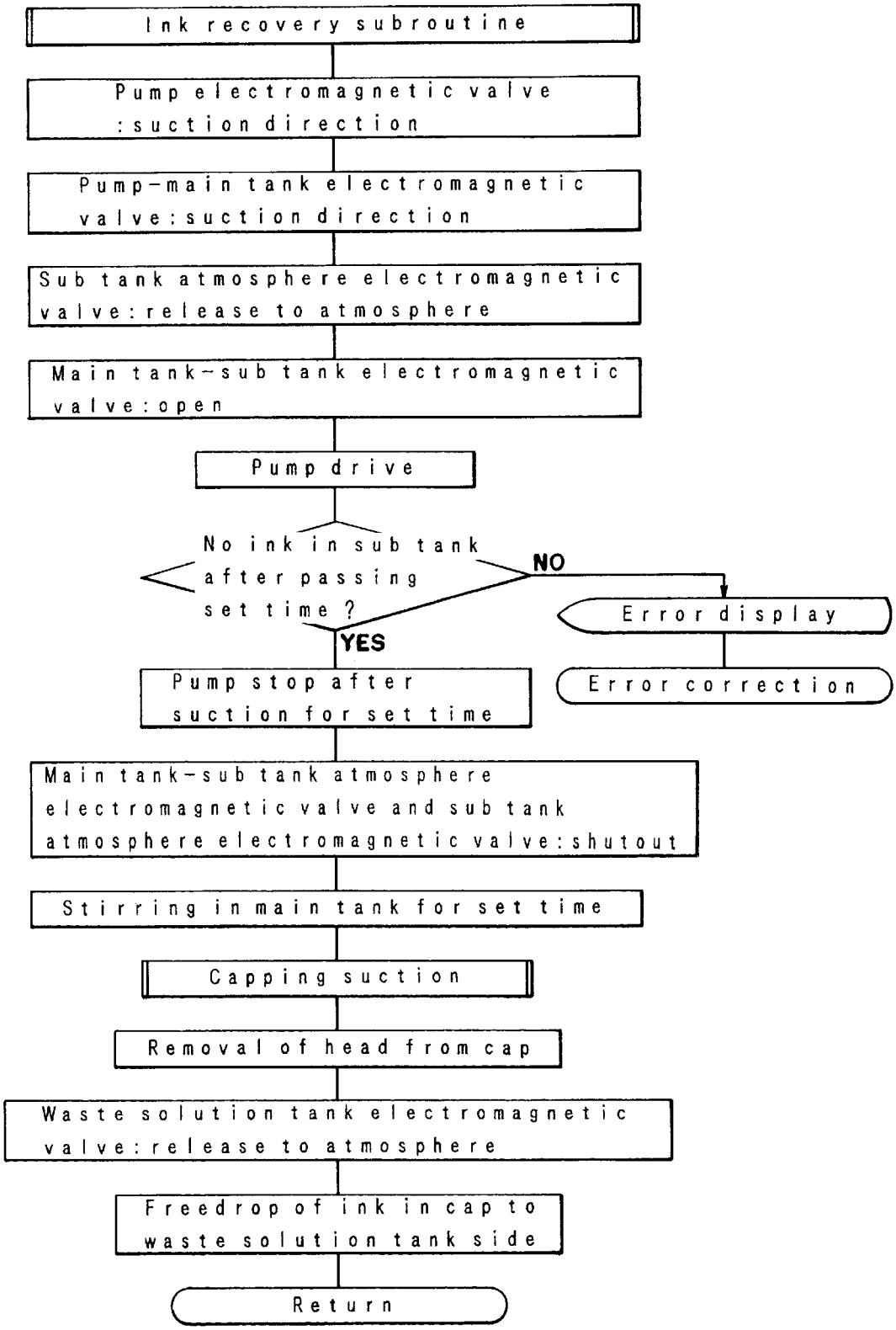
FIG. 8 is a flow chart of an ink recovery operation.

Next, the ink recovery operation shown in FIG. 4 will be described by referring to a flow chart of FIG. 8.

In the first place, the controller changes over the pump electromagnetic valves 68, 70 in the suction direction, and changes over the sub tank atmosphere release electromagnetic valve 90 to atmosphere. Furthermore, it opens the electromagnetic valves 80, 82, 84, 86 between main tanks and sub tanks, and drives the pump 66, and sucks the ink in the sub tanks 54 into the main tanks 60. Next, the controller judges if there is the ink in the sub tanks 54 after passing of the set time. When it judges that there is no ink in the sub tanks 54, the display unit of the controller shows the error, and shifts to the error correction.

In case the judgement is made that there is ink in the sub tanks 54, it drives the pump 66 for a predetermined time, and sucks the ink in the sub tanks 54 into the main tanks 60, and thereafter, stops the pump 66. In this condition, the ink in the sub tanks 54 and the tube cable 122 between sub tanks and main tanks is recovered into the main tanks 60. Next, the electromagnetic valve 56 and the sub tank atmosphere release valve 90 are shut out. Next, it drives the motor 114 and rotates the magnets 8 and the ink in the main tanks 60 are stirred for a predetermined time by driving the motor 114 and rotating the magnets 8 to rotate the rotors 2 in the main tanks 60 by means of the inertia of the magnetic force.

Next, the capping suction operation is performed which will be described later. Next, the caps 108 are removed from the recording heads 52, and the waste solution electromagnetic valve 101 and the cap electromagnetic valves 92, 94, 96, 98, 100 are released to atmosphere. In this operation, the ink in the caps 108 is freely dropped into the manifold 120.

Figure 9:
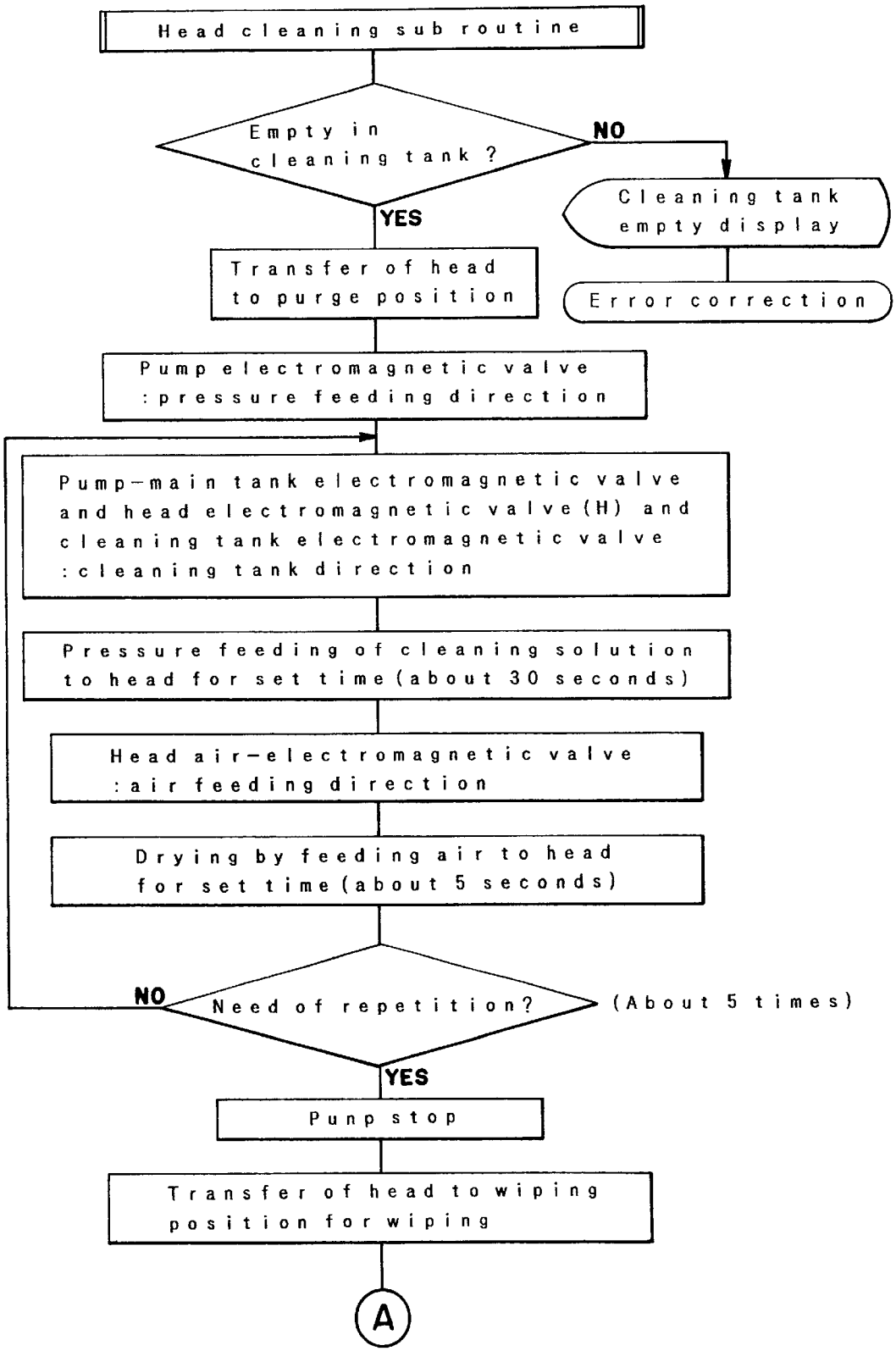
FIG. 9 is a flow chart of a head cleaning operation.
Figure 10:
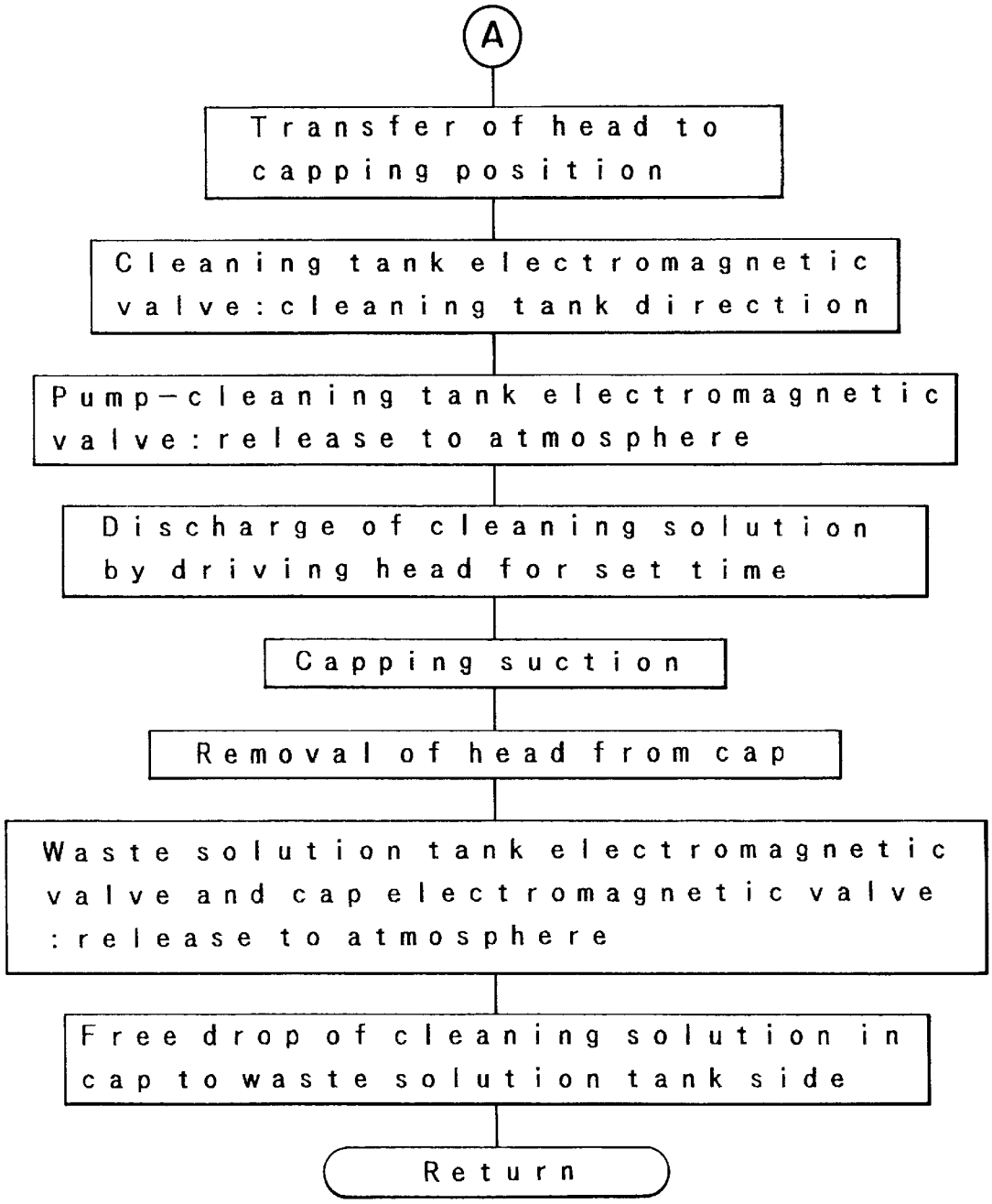
FIG. 10 is a flow chart of a head cleaning operation.

The head cleaning operation shown in FIG. 4 will be described by referring to flow charts of FIG. 9 and FIG. 10.

In the first place, the error correction is performed by judging if there is the remaining quantity or not in the cleaning tank 62 on the basis of the signal of the sensor 138 and displaying the absence of the remaining quantity in the cleaning tank on the display unit if there is no remaining quantity therein.

In case the judgement is made that there is the remaining quantity, the recording heads 52 shift immediately above the waste vent 110 of the purge box 106. Next, the pump electromagnetic valves 68, 70 change over the pressure feeding direction. Next, the pump and main tank electromagnetic valves 72, 76, 74 and the head electromagnetic valve 56 and the cleaning tank electromagnetic valves 78, 88 change over in the cleaning tank direction. Next, it drives the pump 66 and pressure feeds the cleaning solution into the recording heads 52 for a predetermined time (about 30 seconds).

Next, the head air electromagnetic valves 74, 88 change over in the air feeding direction. Next, it drives the pump 66 and feeds the air into the recording heads 52 for a predetermined time (about 5 seconds), and dries the inside of the recording heads 52. Next, the controller judges how many times the air feeding drying operation has been carried out, and makes a judgement that it reaches a predetermined number of times (about 5 times), and stops the drive of the pump 66.

Next, the wiping is carried out by shifting the recording heads 52 to the wiping position. The wiping is carried out by using one piece of the wiper 104 five times. The wiper motor 102 strikes at the stopper by turning in counterclockwise direction. If there is electrical possibility at the initial, the original position is determined by turning counterclockwise direction with current down. In this condition, normally, this position is maintained since the wiper 104 is at a position of not rubbing the recording heads 52.

In one wiping operation, the following ABCDE operation takes place.

A. Confirms that the wiper motor 102 is at the original point.

B. Shifts the Y cursor 40 in the scanning direction to the position of the recording head 52 to be wiped.

C. Rotates the wiper motor 102 in clockwise direction at 72 degrees.

D. Shifts the Y cursor 40 in the direction of the cap 108.

E. Rotates the wiper motor 102 in counterclockwise direction at 72 degrees.

When the wiping is completed, the recording heads 52 shift over the caps 108, and push the recording heads 52 against the caps 108.

Next, the cleaning tank electromagnetic valves 78, 88 are changed over in the cleaning tank direction, and the electromagnetic valve 76 between the pump and the cleaning tank is released to atmosphere. Next, the recording heads 52 are driven for a predetermined time, and the cleaning solution is discharged from the nozzles. The capping suction operation to be described later follows. The caps 108 are separated from the recording heads 52. Next, the waste solution tank electromagnetic valve 101 and the cap electromagnetic valves 92, 94, 96, 98, 100 are released to atmosphere. In this operation, the cleaning solution in the caps 108 freely drop into the manifold 102.

Figure 11:
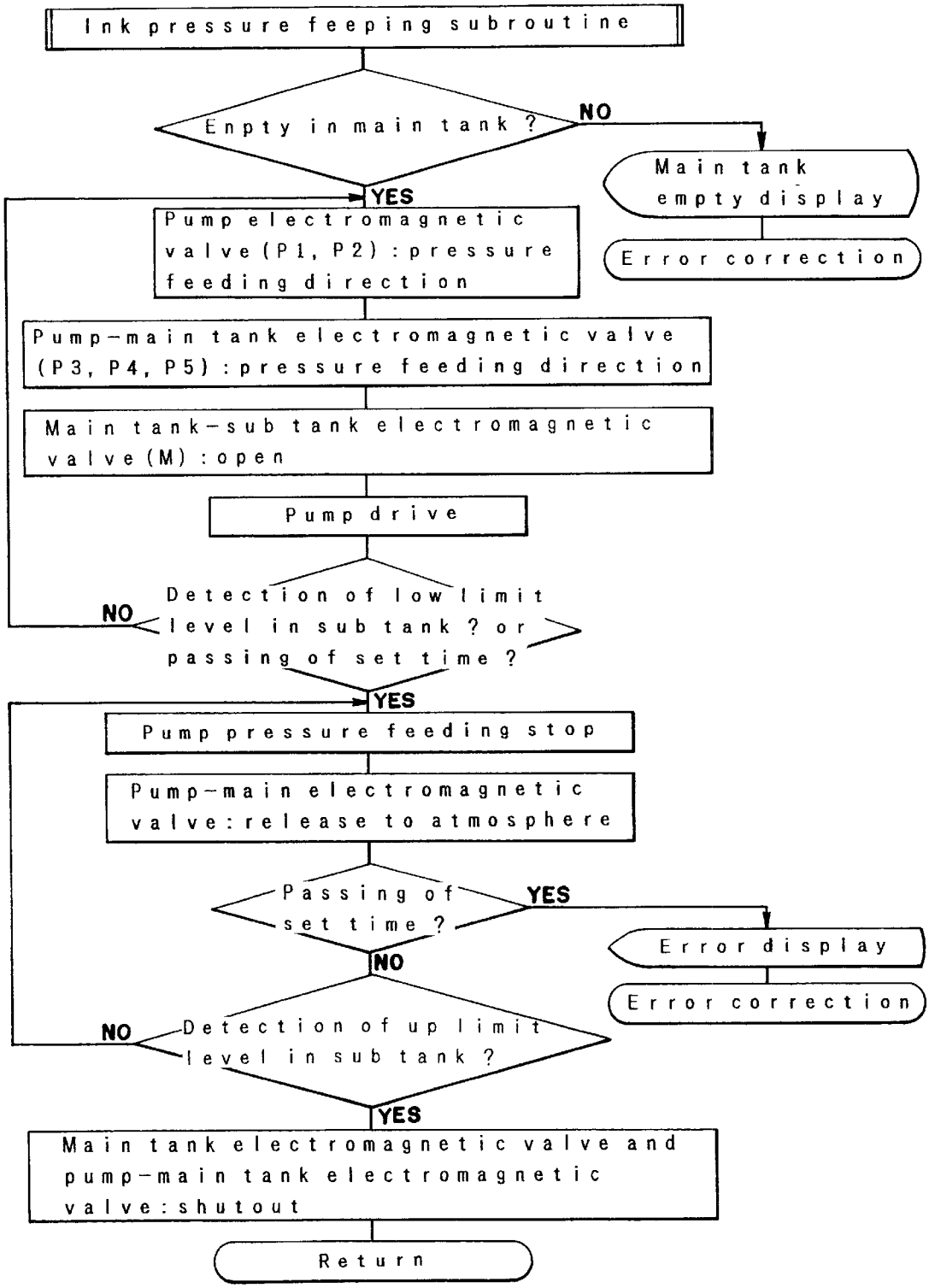
FIG. 11 is a flow chart of an ink pressure feeding operation.

Next, the ink pressure feeding operation shown in FIG. 5 and FIG. 6 will be described by referring to a flow chart of FIG. 11.

In the first place, the controller judges if there is remaining quantity of ink in the main tanks 60 or not on the basis of the signal of the sensor 136, and in case it judges negatively, the display unit displays that no quantity remains in the main tanks, and shifts to the error correction. When it judges affirmatively, changes over the pump electromagnetic valves 68, 70 in the pressure feeding direction, and changes over the electromagnetic valves 72, 76, 74 between the pump and the main tanks in the pressure feeding direction. Also, it opens the electromagnetic valves 80, 82, 84, 86 between the main tanks and sub tanks and drives the pump 66 and pressure feeds the ink to the sub tanks 54.

Next, the controller judges if the low limit level in the sub tanks 54 is detected by the signal of the level sensor or judges if a predetermined time (about 10 seconds) has passed, and judges affirmatively, stops the drive of the pump 66, and releases the electromagnetic valve 76 between the pump and the main tanks to atmosphere. In this operation, the ink freely drops from the main tanks 60 to the sub tanks 54 for 30 seconds. In case, the up limit level sensor in the sub tanks 54 does not detect for this time, it generates an error.

To shut out the atmosphere release of the main tanks 60 at the time when the ink is supplied to the sub tanks 54 normally, the electromagnetic valve 76 is shut out and also, the electromagnetic valves 80, 82, 84, 86 between the main tanks and sub tanks are closed.

If the drafting is not carried out at the time of this point, an atmosphere release valve 90 of the sub tanks 54 is closed to prevent an evaporation of the ink ingredient in the sub tanks 54. In other words, the atmosphere release valve 90 of this sub tanks 54 is kept closed except for the case where the drafting is carried out, during the capping suction and cleaning as well as the recording heads 52 in the action.

Figure 12:
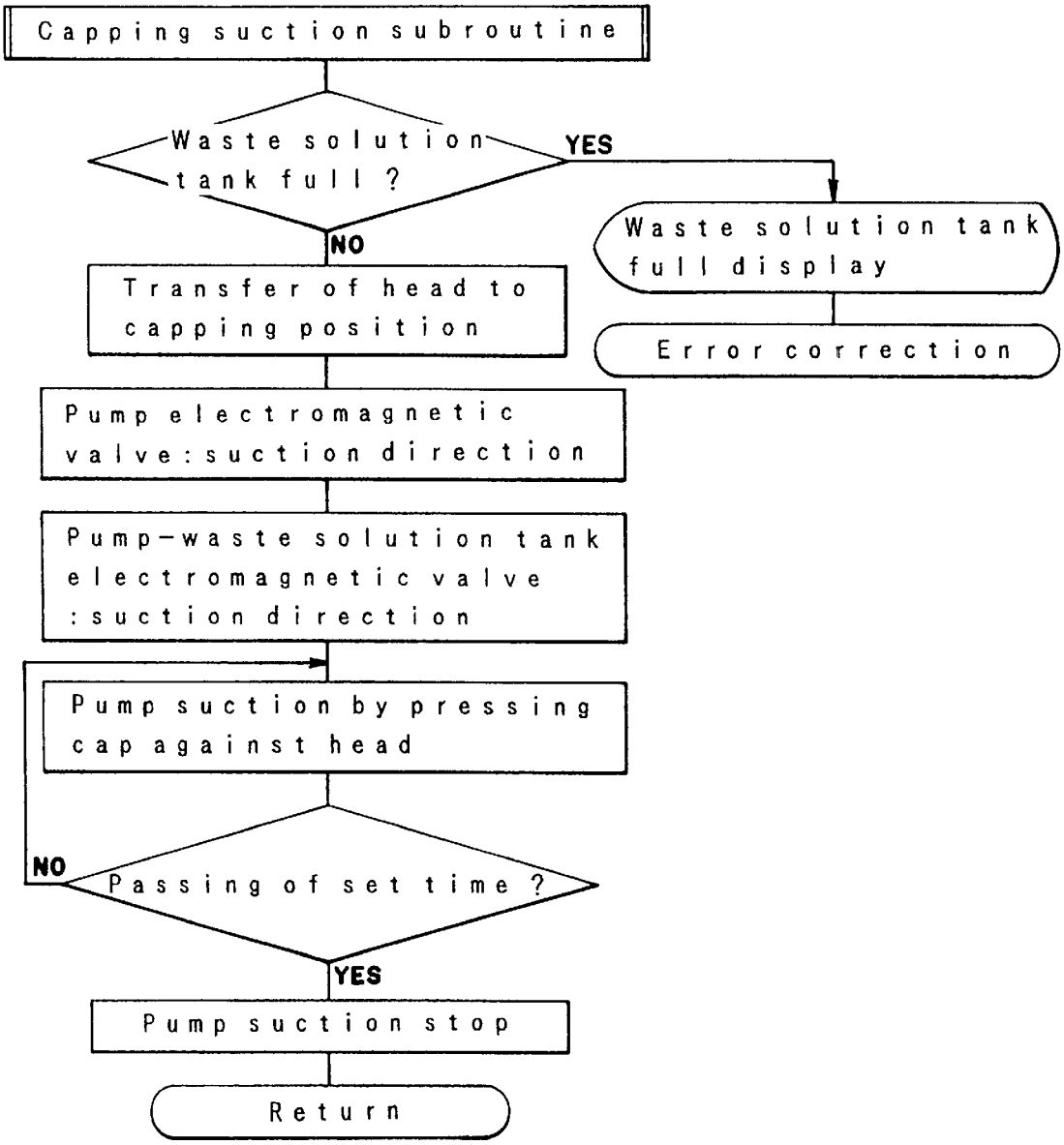
FIG. 12 is a flow chart of a capping suction operation.

Next, the capping operation shown in FIG. 5, FIG. 8 and FIG. 10 will be described by referring to a flow chart of FIG. 12.

The controller, in the first place, judges that the waste solution tank 118 is full or not on the basis of the signal of the sensor 134, and in case it judges affirmatively, it displays that the waste solution tank is full and shifts to the error correction. In case of the negative judgement, it shifts the recording heads 52 to shift immediately above the caps 108. Next, it changes over the pump electromagnetic valves 68, 70 in the suction direction, and changes over the electromagnetic valves 72, 101 between the pump and the waste solution tank in the suction direction.

Next, the controller drives the motor 112 to elevate the purge box 106, and pushes the caps 108 against the recording heads 52 and closes the nozzles of the recording heads 52 with the caps 108. In this condition, the electromagnetic valve 56 remains closed. Also, the cap electromagnetic valves 94, 96, 98, 100 remain open and the waste vent electromagnetic valve 92 remains closed.

Next, the controller drives the pump 66 to keep the inside of the waste solution tank 118 at negative pressure, and sucks the ink in the recording heads 52, including the ink in the tube 53 spanning between the recording heads 52 and the electromagnetic valve 56 to the waste solution tank 118 side.

The controller stops the drive of the pump 66 after a lapse of a predetermined time, and suspends the ink suction operation from the recording head 52. Upon the suspension of operation, the inside of the recording head 52 and the inside of the tube 53 become empty.

The present invention has been constructed as described in the foregoing so that it can perform the drafting of high quality even though it uses the ink of high volatility and its ingredient is easy to separate.

What is claimed is:

1. An ink jet printer comprising:

a carriage capable of reciprocating in an axial direction on a platen;

recording heads mounted on a first side of the carriage;

sub tanks mounted on a second side of the carriage supplying ink to the recording heads;

main tanks provided at a side of the ink jet printer supplying ink to and receiving ink from the sub tanks; and a waste solution tank operable to receive ink from the recording heads, wherein ink in the sub tanks is recovered into respective main tans upon the completion of a printing operation or when the ink jet printer is in standby prior to a printing operation.

2. An ink jet printer in accordance with claim 1, further comprising a pump operable to suck the ink from the recording heads into the waste solution tank.

3. A method of preserving ink in an inkjet printer comprising:

providing a series of main tanks, each having a sub tank associated therewith;

providing a plurality of recording heads, each recording head corresponding to a respective sub tank;

filling each of the sub tanks with ink from a corresponding main tank;

filling each of the recording heads with a predetermined amount of ink supplied from a respective sub tank;

performing a printing operation during which ink from within said recording head is controllably transferred to a printing medium through a discharge outlet;

recovering ink from the sub tanks to the main tanks;

recovering ink from the recording heads to a waste solution tank during a pause in the printing operation; and supplying a cleaning solution from a cleaning solution tank to the recording heads to clean said recording heads and supplying air to the recording heads.

4. A method of preserving ink as in claim 3 further comprising:

stirring the ink in the main tanks, after recovering the ink from the sub tanks to the main tanks.

5. A method of preserving ink in an ink jet printer in accordance with claim 3, further comprising:

detecting whether each respective sub tank contains a predetermined amount of ink and filling the sub tank if the result of the determination is negative.

6. A method of preserving ink in an ink jet printer in accordance with claim 3, wherein each of the sub tanks is positioned lower than the discharge outlet of the recording head.

7. A method of preserving ink in an ink jet printer comprising:

providing a plurality of main tanks, each having a sub tank associated therewith;

providing a plurality of recording heads, each recording head corresponding to a respective sub tank;

providing a plurality of electromagnetic valves each operable to provide a predetermined amount of pressure in a respective conduit to which it is connected, the predetermined amount of pressure including both positive and negative pressure;

filling each of the sub tanks with ink from a corresponding main tank;

filling each of the recording heads with a predetermined amount of ink supplied from a respective sub tank;

performing a printing operation during which ink from within said recording heads is controllably transferred to a printing medium through a discharge outlet in the recording heads;

recovering ink from the sub tanks to the main tanks by suctioning the ink from within the sub tanks into the main tanks;

recovering ink from the recording heads to a waste solution tank during a pause in the printing operation; and supplying a cleaning solution from a cleaning solution tank to the recording heads to clean said recording heads and supplying air to the recording heads.

8. A method of preserving ink in an ink jet printer in accordance with claim 7 further comprising:

providing a sub tank pressure release valve connected to the sub tanks; and controlling the sub tank pressure release valve to be closed continuously except for during the printing operation, during the recovering of ink from the sub tanks and during the filling of the sub tanks with ink from the main tanks.

9. A method of preserving ink in an ink jet printer in accordance with claim 7 wherein a first subset of the electromagnetic valves is placed between a pump and the main tanks, a second subset of the electromagnetic valves is placed between the main tanks and the sub tanks, a third subset of the electromagnetic valves is placed between the sub tanks and the recording heads, and a fourth subset of the electromagnetic valves is placed between a plurality of caps and a manifold, wherein the method further comprises:

controlling the second subset of electromagnetic valves to open when recovering ink from the sub tanks to the main tanks.

10. A method of preserving ink in an inkjet printer in accordance with claim 9 further comprising:

controlling the third subset of electromagnetic valves to close and the fourth subset of electromagnetic valves to open when recovering ink from the recording heads to the waste solution tank, controlling the third subset of electromagnetic valves to open when recovering ink from the sub tanks to the main tanks.

* * * * *